US005115992A

United States Patent [19]

Nugent

[11] Patent Number: 5,115,992

[45] Date of Patent: May 26, 1992

[54] FOOD CUTTING MACHINE

[76] Inventor: Duane C. Nugent, 344 East Second St., Perrysburg, Ohio 43551

[21] Appl. No.: 653,001

[22] Filed: Feb. 8, 1991

[51] Int. Cl.[5] ..... B02C 4/08

[52] U.S. Cl. ..... 241/236; 83/501; 241/295

[58] Field of Search ..... 241/100, 236, 295; 83/500, 501, 502

[56] References Cited

U.S. PATENT DOCUMENTS

| | | | |
|---|---|---|---|
| 342,811 | 6/1886 | Root | 241/295 |
| 3,656,697 | 4/1972 | Nelson | 241/236 X |
| 3,960,335 | 6/1976 | Haberle | 241/236 |

FOREIGN PATENT DOCUMENTS

| | | | |
|---|---|---|---|
| 274938 | 6/1914 | Fed. Rep. of Germany | 241/236 |
| 138205 | 2/1934 | Fed. Rep. of Germany | 241/236 |
| 2524086 | 12/1976 | Fed. Rep. of Germany | 241/236 |
| 1066833 | 1/1984 | U.S.S.R. | 241/236 |
| 421627 | 12/1934 | United Kingdom | 241/236 |
| 2169222 | 7/1986 | United Kingdom | 241/295 |

*Primary Examiner*—Mark Rosenbaum
*Attorney, Agent, or Firm*—Marshall & Melhorn

[57] ABSTRACT

The invention comprises a machine for slicing food products into then strips. Two stacks of spaced, axially aligned circular blades are positioned so as to be driven in counterrotating intermeshing relationship. Each of the blades comprises a central hub connected to a peripheral cutting ring by a plurality of spokes. Spacers are provided between adjacent ones of the circular blades. The stacked blades are assembled with the spokes of succeeding ones of the blades displaced by a predetermined angular amount, so that the spokes define a plurality of helical paths through the interior of the stacks. As the blades are rotated the food product is sliced by being forced between the spaced blades, and the resulting strips are deposited within the interior of the stack to travel along the helical paths defined by the spokes and be discharged at the end of the stack.

17 Claims, 3 Drawing Sheets

FOOD CUTTING MACHINE

BACKGROUND OF THE INVENTION

1. Field of the Invention

The present invention relates generally to the cutting or slicing of food products, and more particularly to the reduction of selected food products to particles or fragments having predetermined dimensional and shape characteristics.

2. Description of the Prior Art

In recent years it has become increasingly popular to incorporate food products such as seeds. nuts and raisins in breakfast cereals. With the trend toward greater awareness of the effect of diet upon a healthy life-style, and the perceived beneficial effect that natural foods can have upon the state of one's health, it has become desirable to incorporate a number of food products not heretofore generally employed for that purpose into dry cereals. Thus, it has been found that various types of dried berries and other small food products may advantageously be added to dry cereals to enhance their flavor and appeal Among the dried products, by way of example, are cherries and cranberries. Such products in their dried state are larger than desirable for incorporation into the cereal, and the individual fruits or berries are preferably reduced to fragments or particles of relatively small size which can be mixed with the dry cereal. To that end, it has been found that thin, elongated strips or slivers of the dried fruits or berries are particularly well suited for this purpose.

In preparatiou for addition to cereal, the raw fruit products are subjected to a sugar-infusion process and then dried to a moisture content on the order of 7 to 13 percent by weight. Numerous machines have been proposed and are commercially available for slicing or dicing fruits and vegetables. Some of these machines employ spaced, rotating circular blades for cutting the products into strips. However none has proven entirely satisfactory for cutting dried, sugar infused fruit and berry products into thin strips as desired for addition to breakfast cereals and other food products.

SUMMARY OF THE INVENTION

The invention has as its principal object the provision of a relatively inexpensive device which will slice dried, sugar infused berries and the like food products into thin elongated strips in an efficient and trouble-free manner. Two stacks of spaced, axially-aligned circular blades are positioned so as to be driven in counterrotating intermeshing relationship with one another. Each stack of blades is mounted on a shaft, and each individual blade comprises a central hub connected to a peripheral ring by a plurality of spokes. Spacers substantially equal in thickness to the blades are provided on the shafts between adjacent ones of the circular blades.

The cutting blades are mounted for rotation with the shaft and are disposed on the shaft in repeating groups wherein the spokes of succeeding ones of the blades in each group are displaced by a predetermined angular amount. The spokes of the first blade of each succeeding group are displaced from the spokes of the last blade of the preceding group by a like angular amount. The spokes thus define a series of helical paths through the interior of the stacks of blades The dried food product is deposited from a hopper onto the blades so as to be carried into the confluence of the counterrotating intermeshing blades. The peripheral rings of the blades overlap sufficiently so that the food product is forced between adjacent spaced blades and cut into strips thereby and the cut strips are deposited within the interior of the rotating blades. The cut strips are carried along the helical paths defined by the spokes of the rotating blades and discharged through the end of the blade stack for subsequent processing Nozzles may be provided for spraying a vegetable oil on the dried food product in the feeding area of the machine as a lubricant for facilitating cutting of the product.

BRIEF DESCRIPTION OF THE DRAWINGS

In the drawings, wherein like numerals refer to like parts throughout.

DESCRIPTION OF THE PREFERRED EMBODIMENTS

Figure 1:
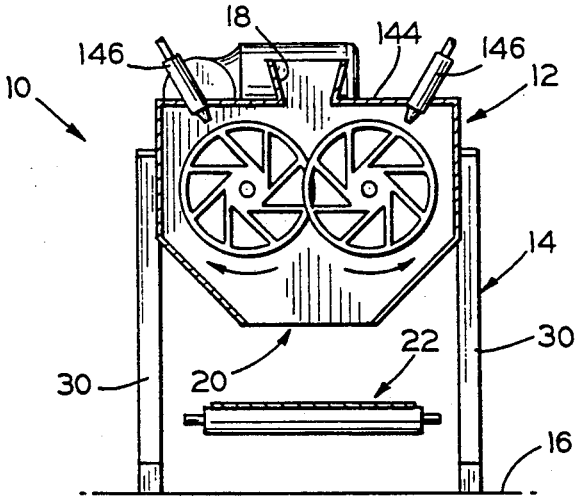
FIG. 1 is a schematic end elevational view of a machine embodying the invention.

With reference now to the drawings and in particular to FIG. 1, there is illustrated generally at 10 a food cutting machine embodying the invention and including a cutting assembly 12 mounted upon a conventional structural framework 14 resting upon a supporting surface 16 such as a factory floor. The machine is adapted to receive a food product through a feed opening 18 and deposit the cut product through a discharge opening 20 onto a conveyor 22 for transfer to appropriate storage or processing equipment (not shown). The framework includes a generally rectangular base 24, which may be formed as of interconnected side and end angle members 26 and 28, respectively, supported open legs 30. Shafts 32 and 33 are mounted in spaced, parallel relationship upon the base 24 for rotation within bearings blocks 34 affixed to the side members 26 as by bolts 35. The shafts extend outwardly beyond the base 24 for carrying the cutting or slicing mechanism as will be hereinafter described.

The shafts 32 and 33 are driven as by means of a suitably controlled variable speed electric motor 36 and associated gear box 38 mounted upon a support plate 40 carried by the base 24. The gear box has an output shaft 42 upon which is mounted a drive gear 44. The gear 44 drivingly engages a first driven gear 46 keyed to the shaft 32. The gear 46 in turn drivingly engages a second driven gear 48 keyed to the shaft 33. The driven gears 46 and 48 are of equal diameter and tooth pitch so that upon operation of the motor 36 to drive the gear 44, the shafts 32 and 33 will be driven at equal speeds in a counterrotating manner as indicated by the arrows in FIGS. 1 and 6.

Figure 2:
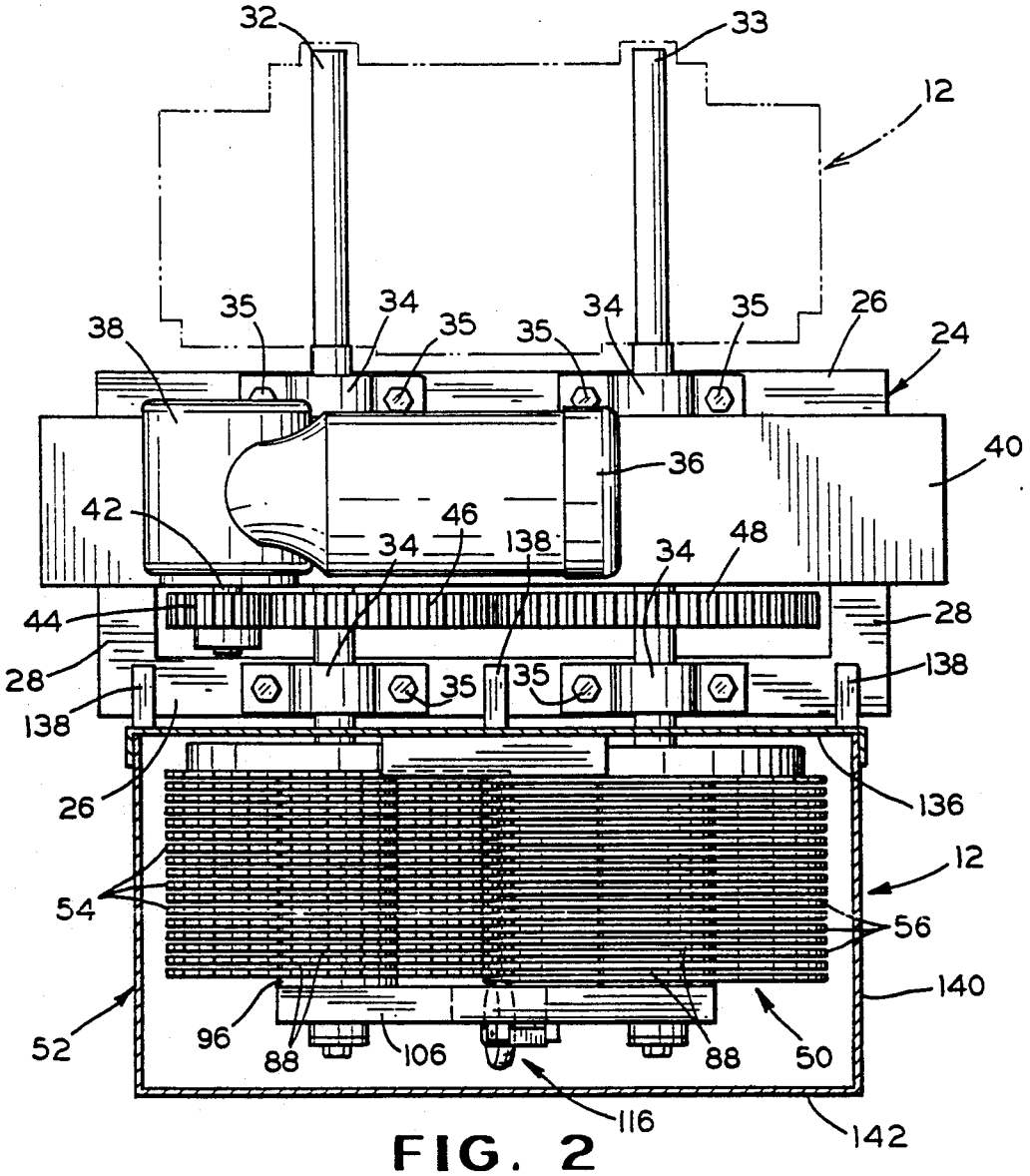
FIG. 2 is an enlarged fragmentary top plan view of the machine, with parts removed.

While a single cutting assembly 12 may be provided as indicated above and as shown in FIG. 2, the shafts 32 and 33 preferably extend in either direction from the base 24 for operating dual assemblies 12 in order to double the cutting or slicing capacity of the machine Since the assemblies are essentially identical, only one mechanism has been illustrated in the drawings and will be described in detail herein. However, it will be understood that a second assembly 12 may be provided as shown generally in phantom in FIG. 2.

Figure 6:
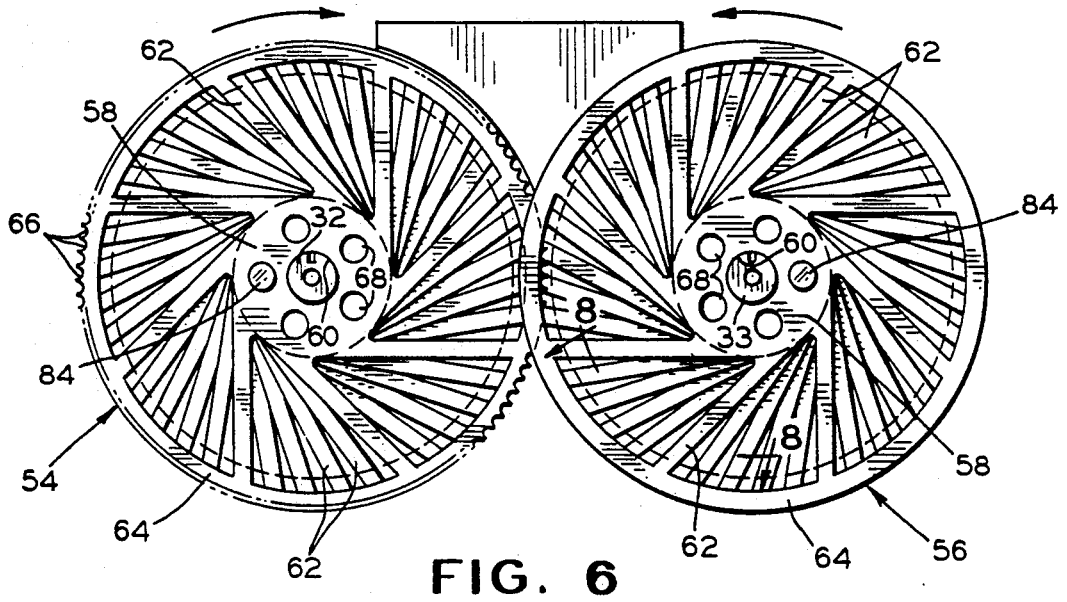
FIG. 6 is an enlarged end view of the stacked intermeshing circular blades, illustrating the staggered, offset relationship of the spokes.

The novel cutting or slicing assembly 12 as will be apparent in FIG. 2, includes a slicer mechanism, identified generally at 50, enclosed within a housing 52. The slicer mechanism comprises a plurality of circular knife blades 54 and 56 mounted in axially spaced relationship upon the shafts 32 and 33, respectively, so as to overlap and intermesh as will be hereinafter described. The blades 54 and 56 are of generally identical construction and differ only in that the circumferential surfaces of the blades 54 in the preferred embodiment are provided with serrations or depressions to assist in drawing the individual units of the food product into the confluence of the counterrotating blades. Thus, as best seen in FIG. 6 each of the knife blades 54 and 56 comprises a central hub section 58 having a central opening 60 for receiving one of the shafts 32 or 33. A plurality of spokes or ribs 62, eight in the illustrated embodiment, extend outwardly from the hub section at equally spaced intervals therearound to a circumferential cutting ring 64 defining the cutting portion of the blade. The blades are of plate-like planar construction and their thickness will be determined by the thickness desired for the cut fragments or particles of the food product.

Figure 7:
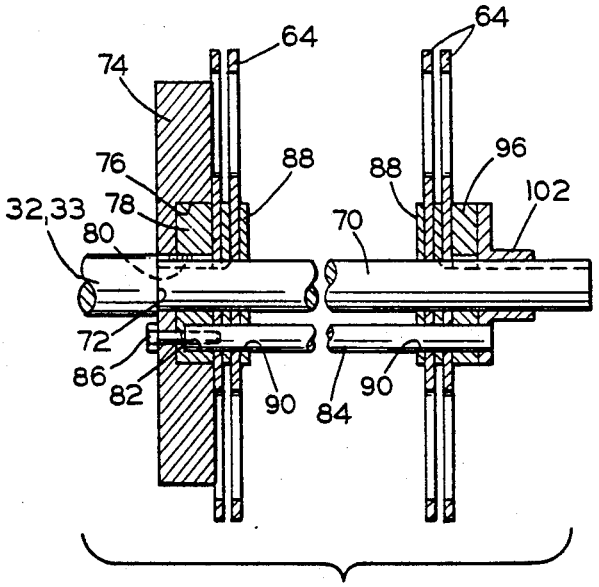
FIG. 7 is an exploded side elevational view, with parts in section, illustrating the mounting of the spaced circular blades on the shafts.

The cutting rings are of rectangular cross section, and the outer peripheral wall of the ring of the blade 54 is provided with a pattern of serrations or depressions 66. The spokes 62 extend generally tangentially from the hub 58 and in the preferred embodiment, eight such spokes are disposed at equally spaced intervals around the knife blades. The blades of the illustrated embodiment are designed to be mounted upon the shafts 32 and 33 in repeating groups of five blades in order to achieve the desired staggered pattern for the spokes, and to that end each blade is provided with a pattern of five locating openings 68 in the central hub 58 equally spaced around the central opening 60 for receiving a locating and drive member when assembled on the machine. As hereinabove mentioned, in order to provide a shearing action between the intermeshing cutting rings 64 of the blades 54 and 56, the cutting rings are of rectangular cross section as shown in FIG. 7. Thus, as the square edges of the rotating knife blades 54 and 56 come together they will cleanly sever the food product as it is forced into the space between the adjacent blades.

Turning now to a description of the assembled slicer mechanism 50, it will be understood that the serrated and plain knife blades 54 and 56, respectively, may be assembled in various combinations as found suitable for cutting or slicing particular ones of the many food products to be processed. Thus, for some products all serrated blades may be employed on one of the shafts 32 or 33 and all plain blades on the other. In other situations, the plain and serrated blades may be alternated on each shaft or may be assembled in groups of one or the other on each shaft. It may be possible to employ all plain blades 56 on both shafts for some products, and it may be desirable to employ all serrated blades 54 on both shafts for others. The size, consistency moisture content and degree of sugar infusion, as well as other factors, will determine the particular arrangement to be employed. One configuration found Particularly suitable for the slicing of dried, sugar-infused cranberries is illustrated in the drawings. Thus, as will be seen in FIG. 2 there is provided on the shaft 32 a plurality of spaced serrated knife blades 54 and on the shaft 33 of plurality of spaced plain knife blades 56 offset axially from the serrated blades by one blade thickness so that the two groups of blades overlap and intermesh The number of knife blades in the assembly may vary depending upon the slicing capacity to be attained.

The manner in which the blades 54 and 56 are assembled on the shafts 32 and 33, respectively, is best seen in FIGS. 6 and 7. Thus, each of the shafts 32 and 33 is formed with an end section 70 of reduced diameter upon which the knife blades are mounted and which creates a radial flange 72 along the shaft A backing plate 74 is received on the end section 70 in abutting relationship with the radial flange 72. The backing plate includes a central recess 76 within which a drive insert 78 is received. The backing plate and drive insert are secured to the shaft for rotation therewith as by a conventional slot and key combination 80. The drive insert 78 includes a recess 82 for receiving the end of a locator/-drive rod 84. The locator/drive rod is secured to the drive insert as by a stud bolt 86 threaded into the end of the rod.

The first knife blade 52 or 54 is assembled on the end section 70 of the shaft 32 or 34, with the rod 84 received in one of the locating openings 68, so as to abut the backing plate 74. There is next assembled on the section 70 a spacer 88 having a configuration similar to the central hub section 58 but with a single opening 90 therein for accommodating the rod 84. The spacer will, of course, be of a thickness substantially equal to that of the knife blades so that the overlapping cutting rings 64 will be in face to face contact with one another. Also, it will be apparent that while on one of the shafts 32 and 33 a knife blade 54 or 56 will abut directly against the backing plate 74 as shown in FIG. 7, on the other of the shafts a spacer 88 will abut the backing plate and drive insert 78 in order to offset the knife blades on the two shafts to accommodate intermeshing or interleaving of the cutting rings as shown in FIG. 6.

Figure 8:
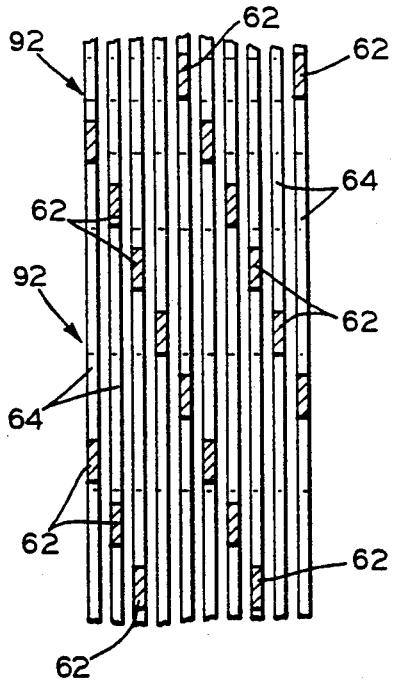
FIG. 8 is an enlarged sectional view taken substantially along line 8—8 of FIG. 6.

Knife blades and spacers are alternately positioned on the shafts 32 and 33, with the cutting rings 64 being overlapped and interleaved, until the predetermined number of knives has been assembled. In accordance with an important feature of the invention as seen in FIGS. 6 and 8, the knife blades are assembled on the shafts 32 and 33 in angularly offset relation so that the spokes 62 of the blade assembly define a series of helical paths 92 through the interior of the assembly. Thus, upon operation of the slicer mechanism 50, sliced or cut fragments of the food product discharged into the interior of the assembly are carried along the helical paths through the assembly by the rotating spokes and discharged at the end of the assembly. The fragments drop into the housing 52 for discharge by gravity through the opening 20.

More particularly, the knife blades are assembled on the shafts 32 and 33 and the locator/drive rod 84 with each succeeding blade angularly offset from the preceding blade in the direction of rotation by a multiple of the angular distance between adjacent ones of the locating openings 68. In other words, in the embodiment illustrated having five such locating openings, adjacent knife blades are offset as by a multiple of 72°, for example 216°. The pattern is repeated in groups of five knife blades so that across the blade assembly, the spokes 62 will be positioned as illustrated in FIG. 8. Of course, as shown in FIG. 6 the knife blades on the shaft 32 will be inverted from those on the shaft 33 so that the food product will be discharged at the same end of the counterrotating knife blade assembly.

Figure 3:
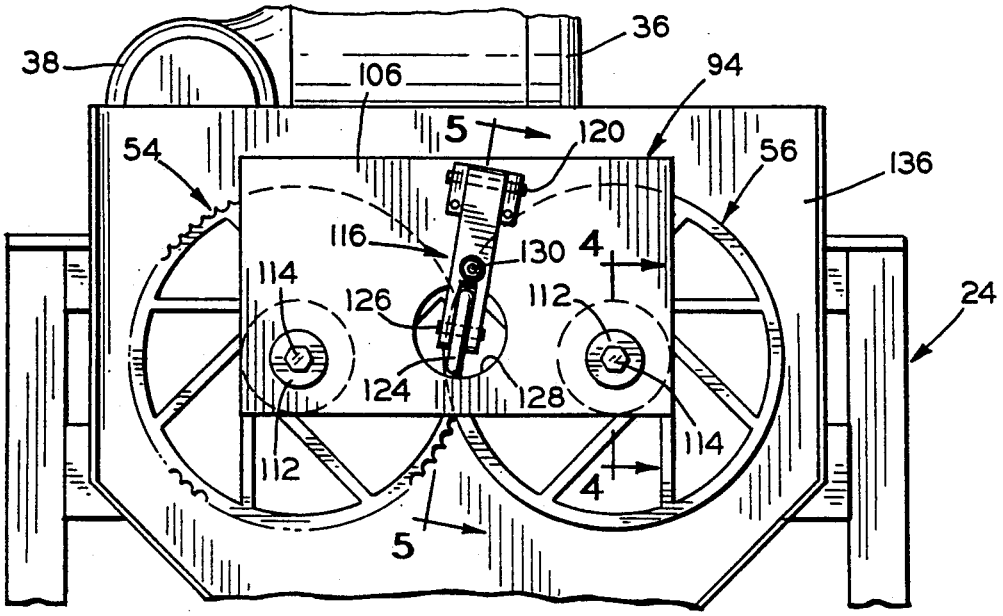
FIG. 3 is an enlarged, fragmentary end elevational view, illustrating the intermeshed blades and roller pressure applicator.
Figure 4:
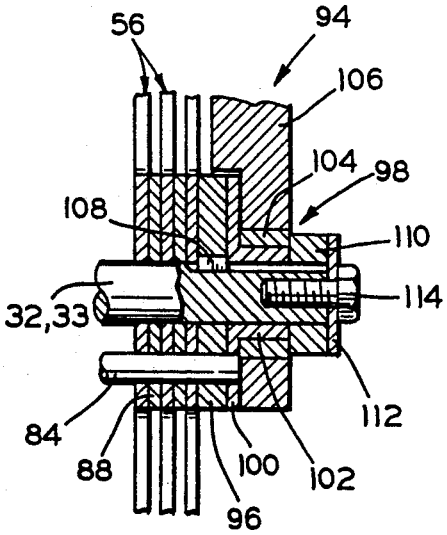
FIG. 4 is an enlarged sectional view taken substantially along line 4—4 of FIG. 3.

The assembled blades are secured upon the shafts 32 and 33 and urged rearwardly against the backing plates 74 by a compression and drive assembly 94 affixed to the distal ends of the shafts More particularly as will be seen in FIGS. 2, 3 and 4 a spacer 88 is positioned on the shaft 33 outside the last knife blade 56 and a spacer 96 equivalent in thickness to one of the knife blades and a spacer 88 combined, is positioned on the shaft 32 adjacent the last knife blade 54 so that the outer surfaces of the spacers 88 and 96 will be generally coplanar with the stacks of blades engaging the backing plates The spacer 96, like the spacer 88, is provided with an opening for receiving the locator/drive rod 84.

A bearing member 98 fitting on the shaft 32 or 33 includes a first radial flange 100 bearing against the spacer 88 or 96, as the case may be, and a second annular bearing flange 102 surrounding the shaft and received within a bushing 104 carried by and end plate 106 interconnecting the remote ends of the shafts 32 and 33. The radial flange includes an opening within which the end of the locator/drive rod 84 is received. The spacers 88 and 96 are keyed to the shaft 32 or 33 for rotation therewith as by a conventional slot and key arrangement 108. The spacer thus insures that the distal end of the locator/drive rod will remain in alignment with the associated shaft 32 or 33 and that the knife blades will be driven and remain in their predetermined staggered relationship. A collar 110 surrounds the shaft and engages the bearing flange 102 and the bushing 104, and the collar is urged axially against the bearing flange and bushing by a washer 112 secured by a stud bolt 114 threaded into the shaft 32 or 33.

Figure 5:
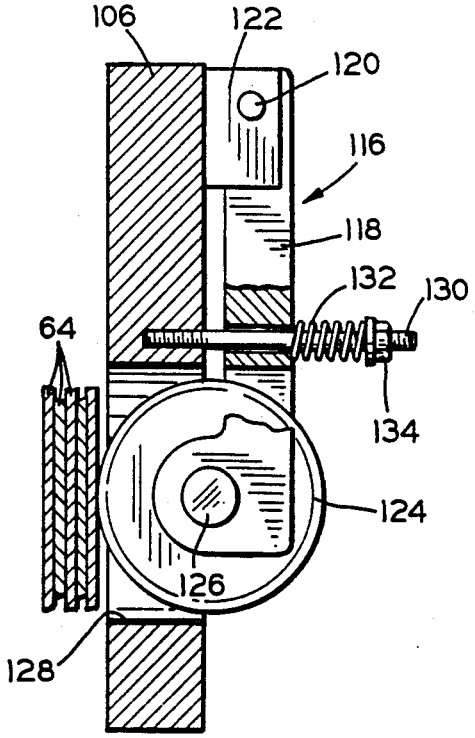
FIG. 5 is an enlarged sectional view taken substantially along line 5—5 of FIG. 3.

As heretofore explained and as shown in FIG. 6, the knife blades 54 and 56 are positioned so that the cutting rings 64 overlap sufficiently to insure that the cut or sliced fragments are ejected from between the spaced knife blades. The cutting rings are in face to face frictional contact in the overlapping area in order to provide the desired shearing action upon the product. The knife blades are generally sufficiently rigid to maintain the shearing action as a result of the pressure applied by the end assembly 94. However, in order to insure that adequate face-to-face contact is maintained between the cutting rings 64, a pressure applicator may be provided as shown generally at 116 in FIGS. 3 and 5 Thus, an arm 118 is pivotally mounted at 120 upon a bracket 122 affixed to the end plate 106. At its free end the arm carries a pressure roller 124 journalled at 126 and positioned to project through an opening 128 for rolling engagement with the surface of the outermost one of the cutting rings 64. A post 130 affixed to the end plate extends through the arm 118 and carries a compression spring 132 adapted to be adjustably urged against the arm as by an adjusting nut 134. Thus the pressure roller 124 urges the cutting rings 64 of the rotating knife blades 54 and 56 into face-to-face contact, with a force which can be adjusted by manipulation of the adjusting nut 124.

The housing 52 may be of any suitable construction for enclosing the slicer mechanism 50 and providing ready access to the slicer mechanism for maintenance and cleaning. To that end, the housing may comprise a rear closure plate 136 affixed to the base 24 as by straps 138. A box-like enclosure including opposite end walls 140, a front wall 142 and a cover plate 144 is suitably configured to be removably supported upon the rear closure plate in a conventional manner. The cover plate includes the feed opening 18 through which the food product is admitted in a controlled manner as from a vibrator feeder thereabove (not shown) to drop onto the slicer mechanism. As hereinabove indicated, it may be desirable in some instances to add a vegetable oil lubricant to facilitate the slicing. To that end spray nozzles 146 connected to a suitably controlled supply of such lubricant (not shown) may be provided on the cover plate 144.

By way of example. a machine was constructed in accordance with the invention and operated for slicing dried cranberries which had been infused with a sugar solution prior to drying. The machine employed fifty knife blades, twenty-five on one of the shafts having serrated cutting rings 64 and twenty-five on the other shaft having unserrated or plain cutting rings. The knife blades had a nominal outside diameter of 12 inches and were formed of type 420 stainless steel having a thickness of about 0.130 inch. The spacers 88 were of a like material and thickness. The cutting rings 64 had a width of ½ inch and the shafts 32 and 33 were mounted 11⅜ inches apart, resulting in an overlap of ⅝ inch of the cutting rings. Thus, each cutting ring extended ⅛ inch beyond the interior surface of the adjacent cutting rings of the other stack. The serrated knife blades were provided with depressions of ⅜ inch diameter about 0.060 inch in depth, at 3° intervals around the periphery. The machine was operated with the knife blades rotating at 37.5 r.p.m. and was found to perform well in slicing the cranberries into elongated particles having the desired thickness.

It is to be understood that the forms of the invention herewith shown and described are to be taken as illustrative embodiments only of the same, and that various changes in the shape, size and arrangement of parts. as well as various procedural changes may be resorted to without departing from the spirit of the invention.

What is claimed is:

1. A machine for slicing food products comprising first and second stacks of axially aligned, spaced circular knife blades, each said circular knife blade comprising a central hub section and a circumferential cutting ring interconnected by a plurality of spaced spokes, said stacks being positioned so that upon rotation the circumferential cutting rings of the knife blades of said first stack intermesh with and overlap the circumferential cutting rings of the knife blades of said second stack each succeeding circular knife blade in each said stack being displaced by a predetermined angular amount from the preceding knife blade whereby said spaced spokes of said stacks of axially aligned knife blades define helical paths through said stacks from end to end thereof, and drive means for rotating said first and second stacks in opposite directions about their longitudinal axes whereby a said food product supplied to the confluence of said opposite rotating first and second stacks is sliced between said cutting rings into elongated strips and said strips are forced between said rings and deposited within said helical paths defined by said spaced spokes for carriage along said helical paths and discharge at an end of said blade stacks.

2. A machine for slicing food products as claimed in claim 1 wherein said intermeshing circumferential cutting rings of said first and second stacks of knife blades are in face-to-face contact.

3. A machine for slicing food products as claimed in claim 1, wherein said circumferential cutting rings are of rectangular cross-section comprising a pair of spaced radial side walls, an annular outer end wall and an annular inner end wall, the radial side walls of the cutting rings in each one of said stacks engaging the radial side walls of the cutting rings in the other one of said stacks in face-to-face contact as said stacks rotate.

4. A machine for slicing food products as claimed in claim 3 including pressure applicator means for axially urging said cutting rings into said face-to-face contact.

5. A machine for slicing food products as claimed in claim 3, wherein said annular outer end wall of at least some of the said cutting rings in at least one of said stacks is serrated.

6. A machine for slicing food products as claimed in claim 5, wherein the annular outer end wall of each of said cutting rings in said one stack is serrated.

7. A machine for slicing food products as claimed in claim 3, wherein said annular outer end walls are serrated.

8. A machine for slicing food products as claimed in claim 1, wherein each said circular knife blade includes at least six said spokes equally spaced therearound, and locating means for positioning each said knife blade in any one of a plurality of angular positions within said stacks.

9. A machine for slicing food products as claimed in claim 8, wherein each said circular knife blade includes eight said spokes and said locating means is adapted to position said knife blade in any one of five said angular positions.

10. A machine for slicing food products comprising a supporting base, first and second spaced, parallel shafts mounted upon said base for rotation about their longitudinal axes, a plurality of circular knife blades mounted upon each of said shafts in spaced, stacked relationship and comprising first and second stacks of said knife blades upon said first and second shafts, respectively, said first and second stacks of knife blades overlapping and intermeshing with one another, each said knife blade comprising a hub portion and a circumferential cutting ring interconnected by a plurality of spoke members spaced around said knife blade, said knife blades being positioned upon said shafts with successive knife blades in each said stack displaced by a predetermined angular amount from the preceding knife blade whereby said spaced spokes define a plurality of helical paths through said stacks from end to end thereof, and drive means coupled to said first and second shafts for simultaneously rotating said shafts in opposite directions whereby a said food product supplied to the confluence of said oppositely rotating first and second stacks is sliced between said cutting rings into elongated strips and said strips are forced between said rings and deposited within said helical paths defined by said spaced spoke for carriage along said helical paths and discharge at an end of said blade stacks.

11. A machine for slicing food products as claimed in claim 10, including a housing enclosing said first and second stacks of knife blades, said housing including a feed opening positioned to receive said food products and deposit said food products onto the converging counterrotating first and second stacks of knife blades, means collecting the sliced food product discharged from the ends of said rotating stacks, and an outlet opening for discharging the sliced food product from said housing.

12. A machine for slicing food products as claimed in claim 11, wherein said housing includes a cover plate over said first and second stacks of knife blades, and including at least one spray nozzle carried by said cover plate for depositing a spray of lubricant upon said knife blades.

13. A machine for slicing food products as claimed in claim 10, wherein said first and second stacks of knife blades comprise a first cutting assembly, and including a second one of said cutting assemblies at the ends of said first and second shafts opposite said first cutting assembly.

14. A machine for slicing food products as claimed in claim 10, including a backing plate affixed to each of said first and second shafts for rotation therewith behind said first and second stacks of knife blades, and a locator/drive rod projecting from each said backing plate through the associated stack of knife blades.

15. A machine for slicing food products as claimed in claim 14, including spacer members between the spaced knife blades of each said stack, each said hub portion including a plurality of openings spaced radially therearound said locator/drive rod extending through a selected one of said openings for positioning said knife blade in selected angular positions.

16. A machine for slicing food products as claimed in claim 15, including means rollingly engaging the outermost one of said cutting rings at the end of said stacks opposite said backing plates for urging said overlapping cutting rings toward said backing plate and into face to face engagement.

17. A machine for slicing food products as claimed in claim 15, including means at the ends of said locator/drive rods remote from said backing plate for locking said rods to their associated shaft for rotation therewith.

* * * * *